United States Patent [19]

Lowdermilk

[11] 4,103,471

[45] Aug. 1, 1978

[54] ATMOSPHERE EXCHANGING AND BAG SEALING MACHINE AND METHOD

[75] Inventor: Loren L. Lowdermilk, Middletown, N.J.

[73] Assignee: International Paper Company, New York, N.Y.

[21] Appl. No.: 823,333

[22] Filed: Sep. 1, 1977

[51] Int. Cl.[2] ..... B65B 31/06

[52] U.S. Cl. ..... 53/22 B; 53/7; 53/79; 53/112 B

[58] Field of Search ..... 53/7, 12, 22 B, 79, 53/86, 112 B

[56] References Cited

U.S. PATENT DOCUMENTS 2,780,043 2/1957 Hensgen ..... 53/86

3,501,888 3/1970 Egli et al. ..... 53/112 B X

*Primary Examiner*—Travis S. McGehee

*Attorney, Agent, or Firm*—Charles B. Smith; Robert R. Jackson

[57] ABSTRACT

A machine and method which withdraws an atmosphere from a bag and substitutes a new atmosphere and thereafter seals the bag. More particularly, a bag is disposed around a manifold and the portions of the bag which extend outwardly from the manifold are heat sealed. Thereafter, the unsealed portions of the bag are temporarily sealed around the manifold, the atmosphere within the bag is exchanged and the bag is then completely sealed while the manifold is positioned within the open end of the bag.

41 Claims, 16 Drawing Figures

310
308
312
306
320
318
304
322
168'
162
123
161
163
22
352
387
160
354
22a
22b
388
334
336
234
356
316
338
337
348
346
332
342

ATMOSPHERE EXCHANGING AND BAG SEALING MACHINE AND METHOD

BACKGROUND OF THE INVENTION

Many food articles are packaged within a plastic bag and, to extend the period of time during which such items can be stored and to minimize the need for refrigeration, the atmosphere within the bag, which initially is air, is withdrawn and replaced by a selected gas. Thereafter, the bag is completely sealed whereby the food articles within the bag are protected from spoilage.

The field to which this invention pertains is a method and machine for heat sealing a bag and for providing, in conjunction therewith, the exchange of the atmosphere within the bag.

SUMMARY OF THE INVENTION

In accordance with a preferred embodiment of this invention, a bag is disposed in relation to a machine such that the open end of the bag surrounds a manifold. The manifold is fixedly mounted on the frame of the machine. Preferably, the bag is secured within the machine by downwardly extending fingers which urge the edges of the bag outwardly, thereby holding the bag taut within the machine.

Thereafter, a support member is moved along a curvilinear path. Disposed on the support member is a clamp which clamps a portion of one wall of the bag against one side of the manifold. Also mounted on the support member are backing members and a first pair of vertically disposed clamps, which are positioned adjacent to the sides of the manifold at the end of the forward movement of the support member. After forward movement of the support member, two heat seal bars move toward the bag whereby the outwardly extending portions of the bag are sandwiched between the heat sealing bars and the backing members. Thereby, two heat seals are formed in the bag, i.e., the portions of the bag extending outwardly from the manifold are heat sealed together and a portion of each of the heat seals extends from a point above the bottom end of the manifold to a point below the bottom end of the manifold. Thereafter, the heat seal bars are retracted and a second clamp is moved to its forward position, whereby a portion of the other wall of the bag is urged against the other side of the manifold. Simultaneously, the portions of the bag adjacent to the sides of the manifold are sandwiched between a second pair of vertically disposed clamping members and said first pair of vertically disposed clamps. By this mechanism, the unsealed portion of the bag is temporarily sealed around the manifold.

The atmosphere within the bag is then exchanged through the manifold, i.e., the air initially within the bag is withdrawn and a selected gas is substituted. During the withdrawing step, means for maintaining the side walls of the bag in spaced apart relation are preferably inserted into the bag through the manifold. After the atmosphere has been exchanged, the means for spacing apart the walls of the bag is withdrawn and a third heat seal is formed which extends across the bag and intersects portions of the first two heat seals. In this manner, the bag is completely sealed and the final sealing operation occurs while a portion of the manifold is extending into the open end of the bag.

DESCRIPTION OF PREFERRED EMBODIMENT

Figure 1:
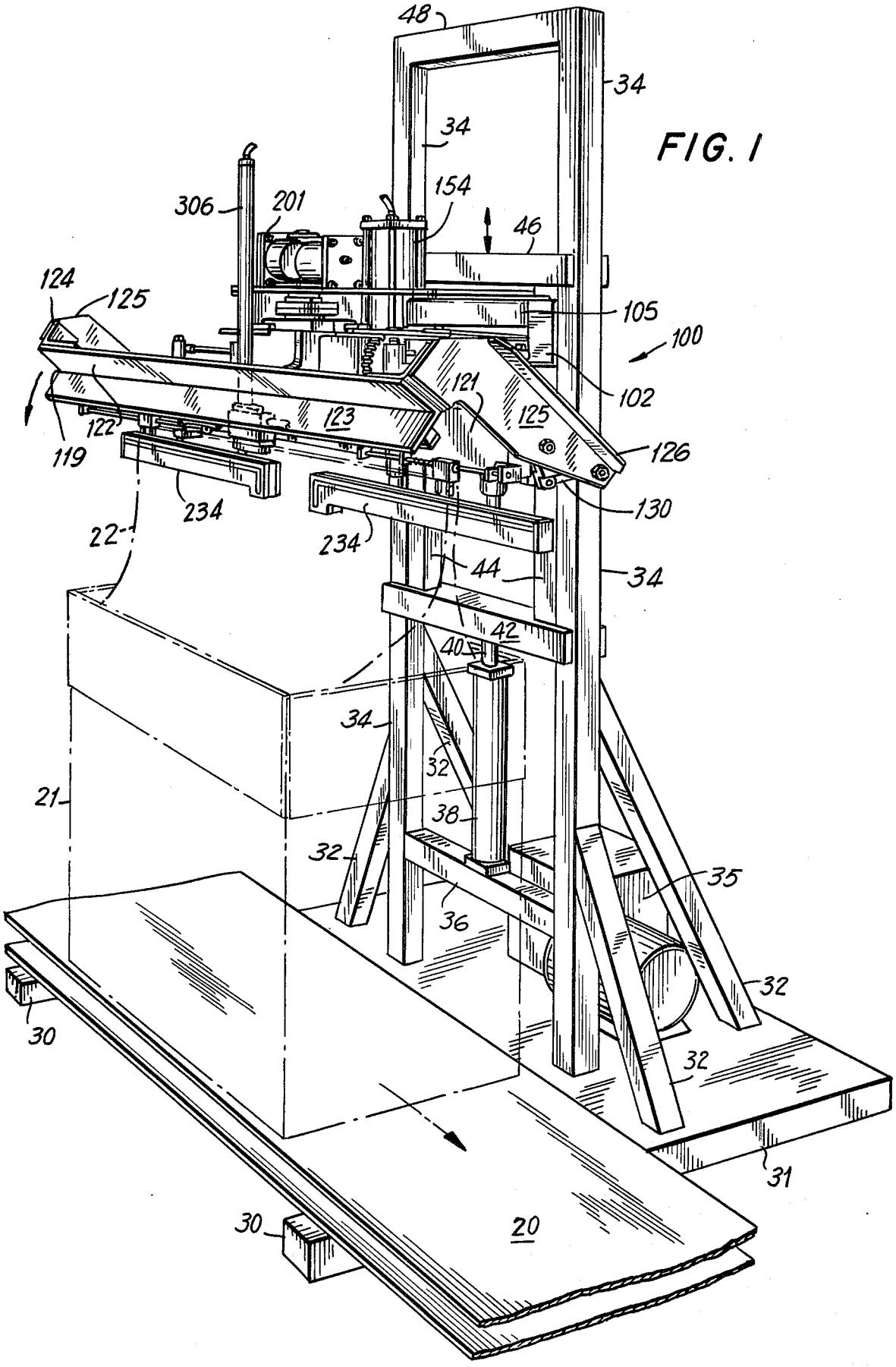
FIG. 1 is a perspective view of a preferred embodiment of an apparatus embodying my invention.

Referring to FIG. 1, there is shown therein a perspective view of a machine 100 which is constructed in accordance with a preferred embodiment of my invention. As shown in FIG. 1, the machine includes a base 31 having forwardly extending legs 30. Preferably, the base 31 and the legs 30 are mounted on wheels whereby the machine 100 may be moved and then fixed in position.

Extending upwardly from and fixedly secured to the base 31 are frame members 34. Associated therewith are frame support members 32. At the top of the machine 100, a cross-member 48 joins the upwardly extending members 34. Mounted within the upwardly extending frame members 34 are two cross-members 42 and 46. The members 42 and 46 are joined together by vertically extending members 44 thereby defining an inner frame which is vertically moveable along the upwardly extending frame members 34. To provide such vertical movement, a hydraulic cylinder 38 is provided. The lower end of the cylinder 38 is secured to the cross-member 36 which is fixed to the members 34. The piston 40 which extends from the cylinder 38 is secured to the cross-member 42, whereby upon actuation of the cylinder 38, the moveable frame defined by the members 42, 44 and 46 may move up and down along the frame members 34.

Figures 1A, 1B:
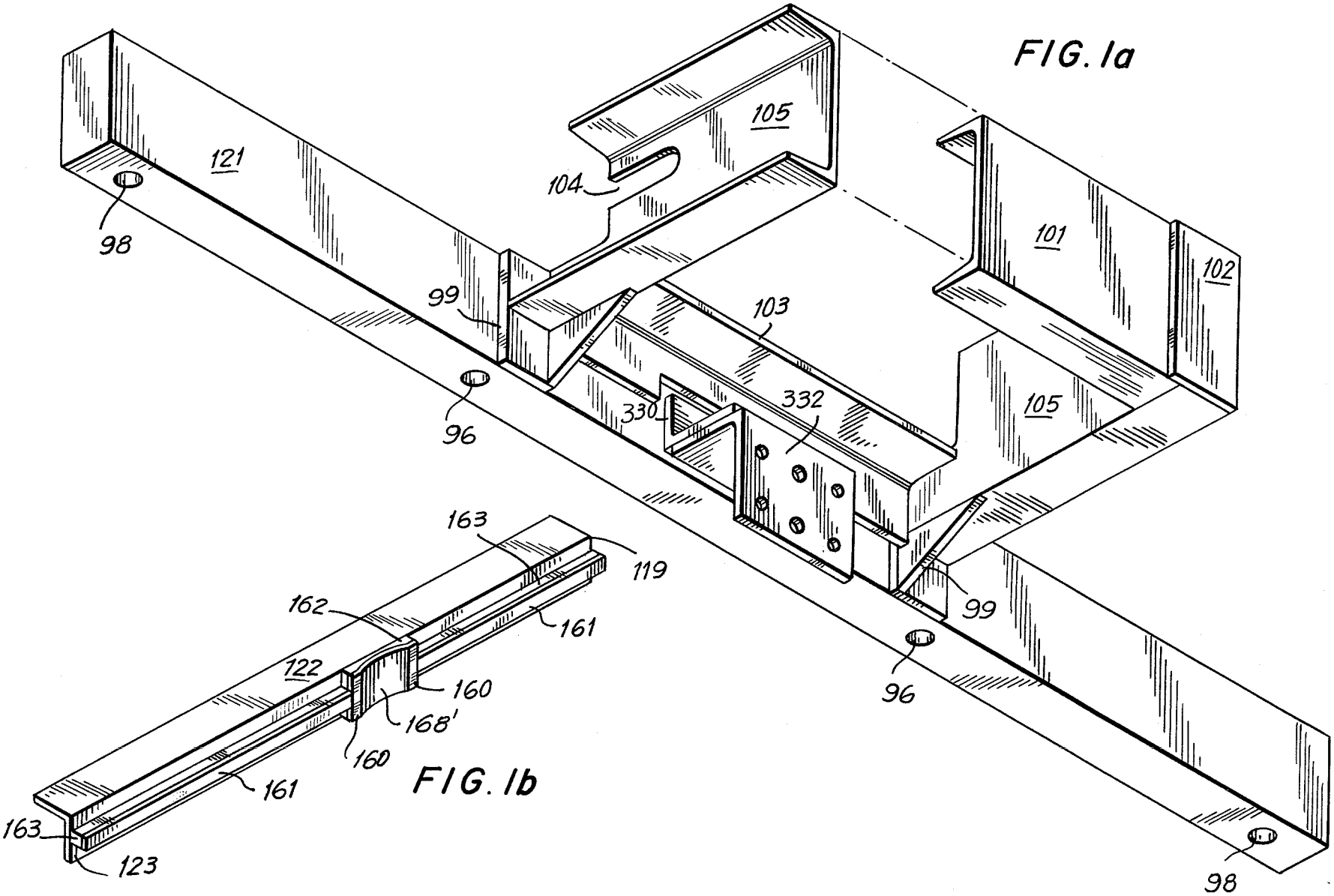
FIG. 1*a* is a bottom, perspective view of certain of the frame members of the apparatus shown in FIG. 1.
FIG. 1*b* is a perspective view of one of the operating members of the apparatus shown in FIG. 1.

FIG. 1*a* is a perspective view showing certain frame and support members of the machine 100 as viewed from the rear of the machine and looking upwardly and with a number of the parts of the machine 100 removed for clarity. Thus, referring to FIGS. 1 and 1*a*, a plate 102 (only one of which is shown in FIG. 1*a*) is secured to each of the vertically extending numbers 44. Extending outwardly from the plate 102 and secured thereto are two channels 105. Extending between each of the channels 105 and secured thereto and secured to the mounting plate 102 is a channel 101. Each of the channels 105 is secured to the block 121 by the mounting members 99 shown in FIG. 1*a*. Also secured to the block 121 is a transverse member 103, which extends between and is secured to each of the channels 105. Secured to the inner surface of the block 121 is a bracket 330 having a second bracket 332 secured thereto. As shown in FIG. 1*a*, two pairs of holes 96 and 98 are provided through the block 121.

Figure 2:
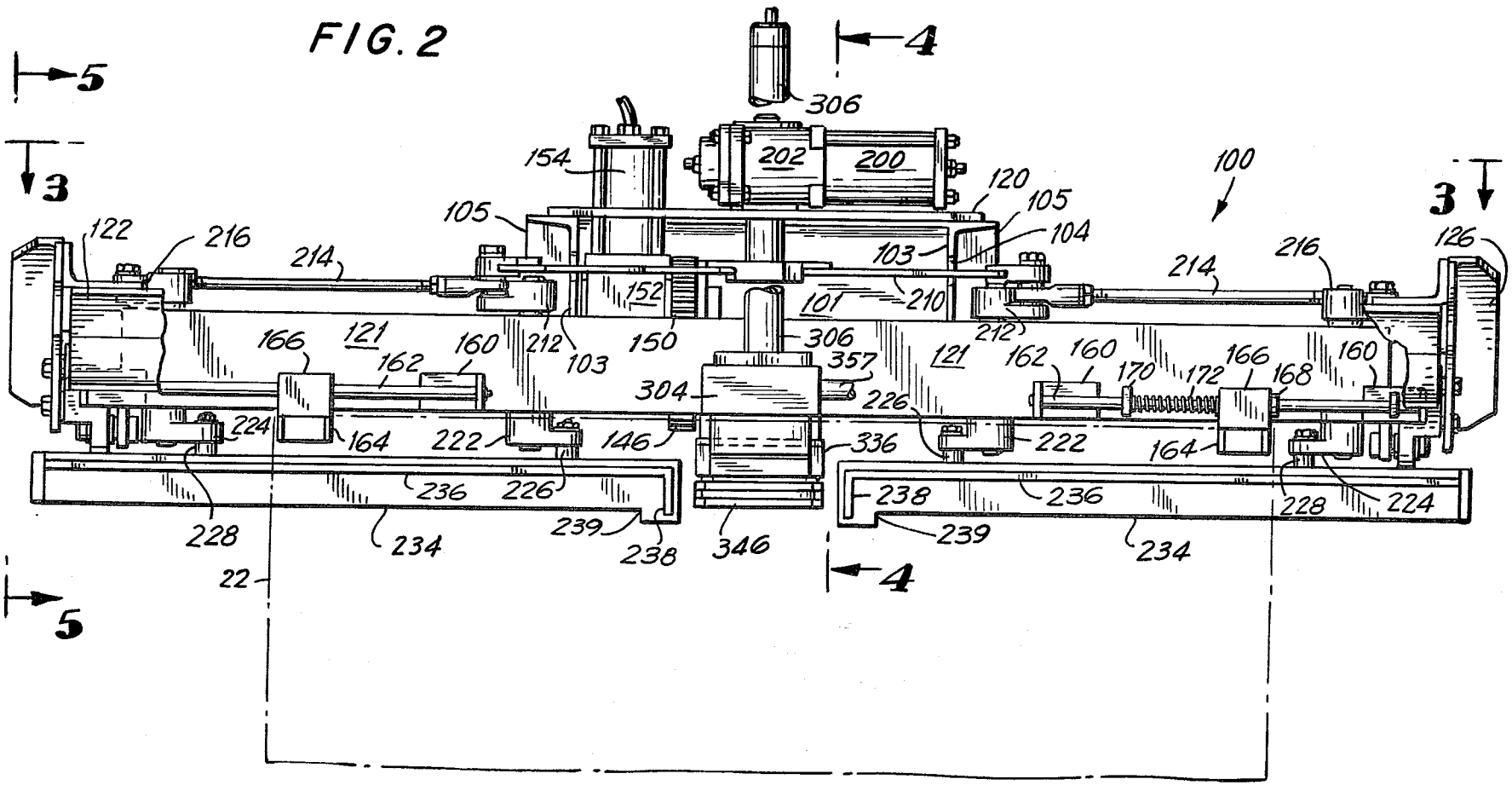
FIG. 2 is a front view of a part of the apparatus shown in FIG. 1.
Figure 3:
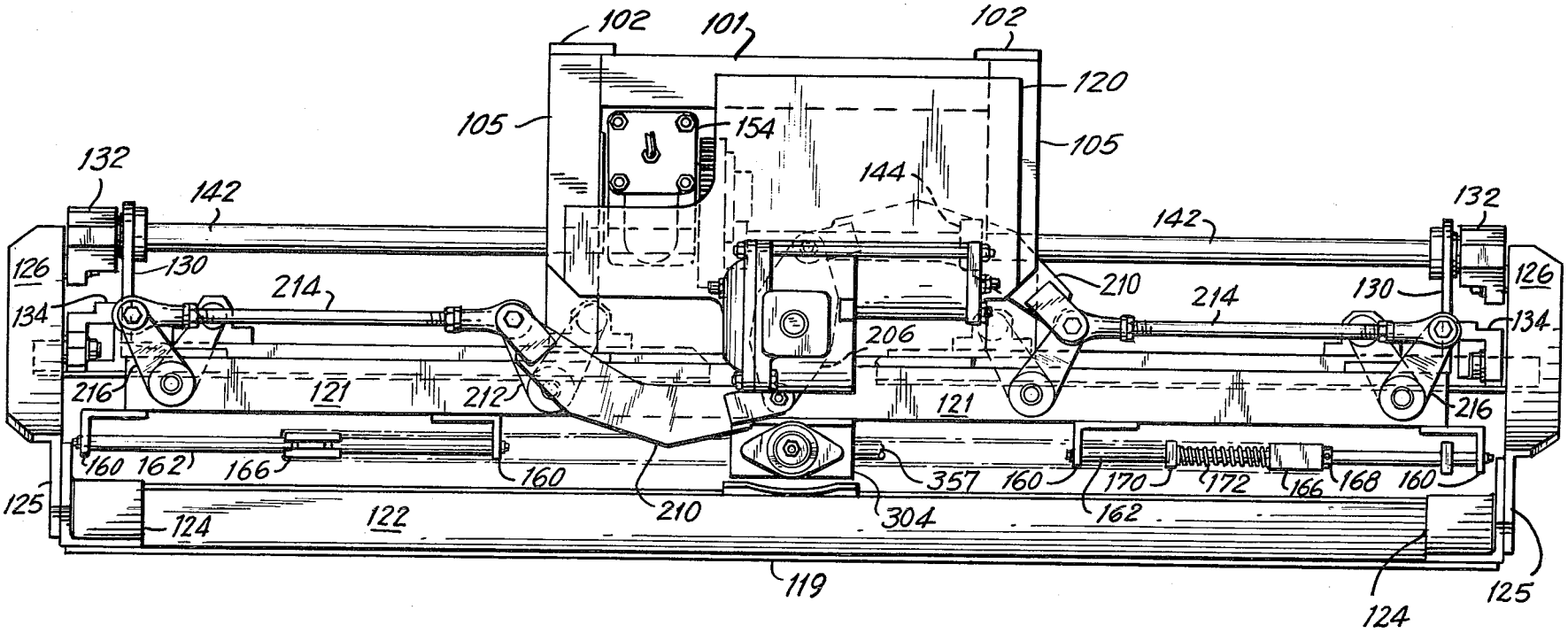
FIG. 3 is a top view of the apparatus shown in FIG. 2.

Referring to FIGS. 2 and 3, two pairs of brackets 160 are secured to the front of the block 121 and a shaft 162 extends between and is fixedly mounted in each pair of brackets 160. Considering the left hand portion of the machine shown in FIGS. 2 and 3, a plate 166 is slidably mounted on the shaft 162 and includes a downwardly extending finger 164. The plate 166 on the left hand side of the machine shown in FIGS. 2 and 3 is provided with a set screw, whereby the mounting plate 166 may be secured in a particular position along the shaft 162.

Considering the shaft 162 shown on the right side of FIGS. 2 and 3, another mounting plate 166 is provided and includes a downwardly extending finger 164.

On the right side of the mounting plate 166 is a collar 168 and on the left side of the mounting plate 166 is a spring 172. The other end of the spring 172 bears against the collar 170. The collars 168 and 170 are adjusted so that the spring 172 is in compression, i.e., the mounting plate 166 and the downwardly extending finger 164 may be moved to the left against the compression of the spring 172. Thus, the spring 172 urges the finger 164 outwardly.

As shown in FIG. 1, a support member 119 in the shape of an L-bracket extends across the front of the machine and is comprised of the portions 122, 123. As shown in FIG. 1*b*, a plate 162, having a concave inner surface and vertically extending flat portions is secured to the portion 123 of the support member 119. Secured to the plate 162 and conformed with the surface thereof is a block of rubber, whereby there is formed a concave clamping section 168' and a pair of planar, vertically disposed clamps 160. Extending outwardly from the plate 162 are two mounting plates 163 which are mounted on the portion 123 of the support members 119. Secured to the surface of each of the plates 160 is a rubber backing member 161.

As shown in FIGS. 1 and 3, each end of the support member 119 is secured to a respective arm 125 by brackets 124. Each of the brackets includes an outwardly extending flange 126.

Figure 7:
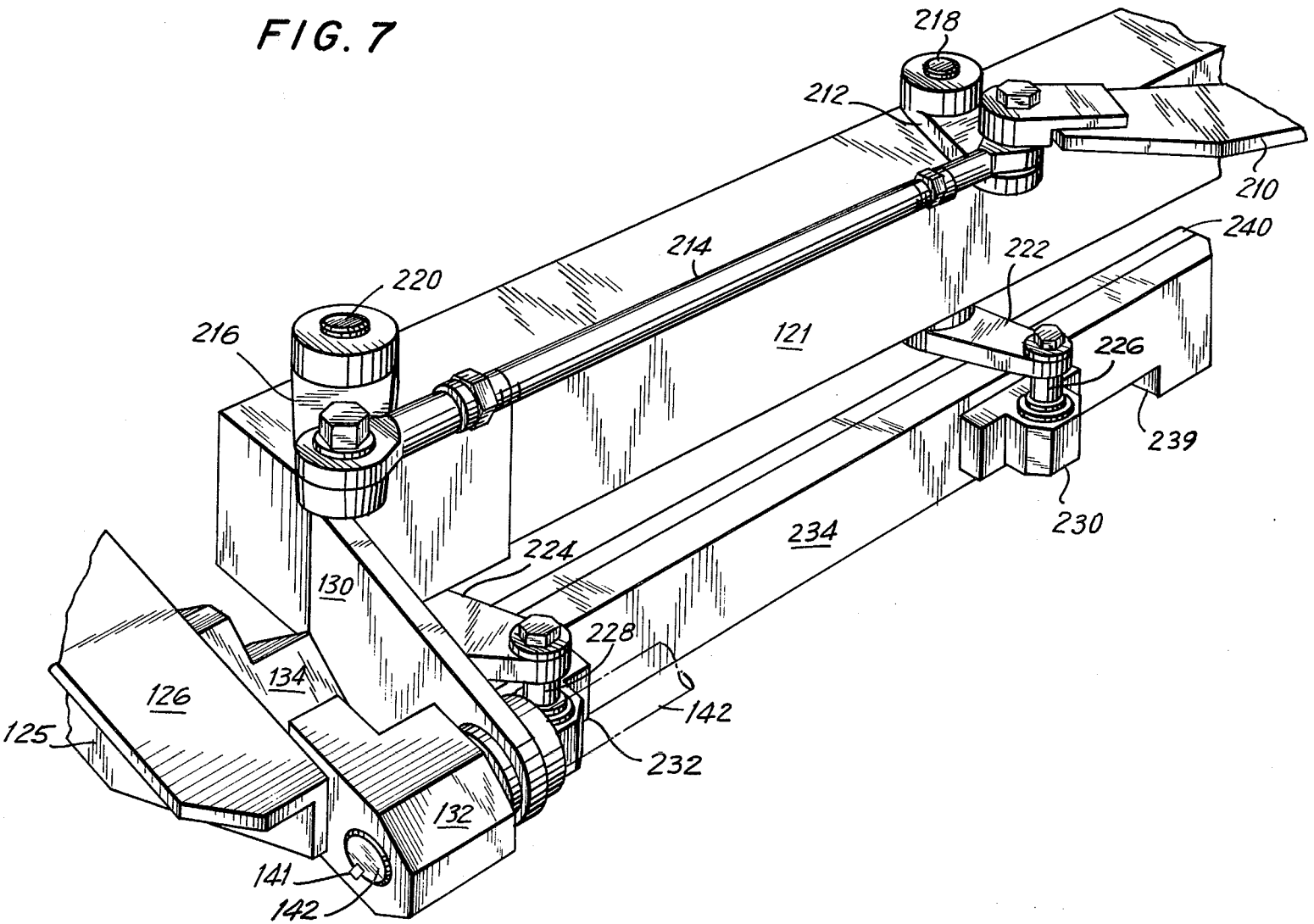
FIG. 7 is a perspective view of a portion of the apparatus shown in FIG. 1.

As shown in FIGS. 3 and 7, a plate 130 extends rearwardly from each end of the block 121. Each of the arms 125 is connected to a respective one of the plates 130 by connecting links 132, 134. Thus, each of the plates 130, each of the arms 125, and each of two links 132, 134 comprise a four bar linkage. As may be seen in FIG. 3, a shaft 142 extends across the machine and is keyed, as shown at 141 in FIG. 7, to each of the links 132.

Figure 4:
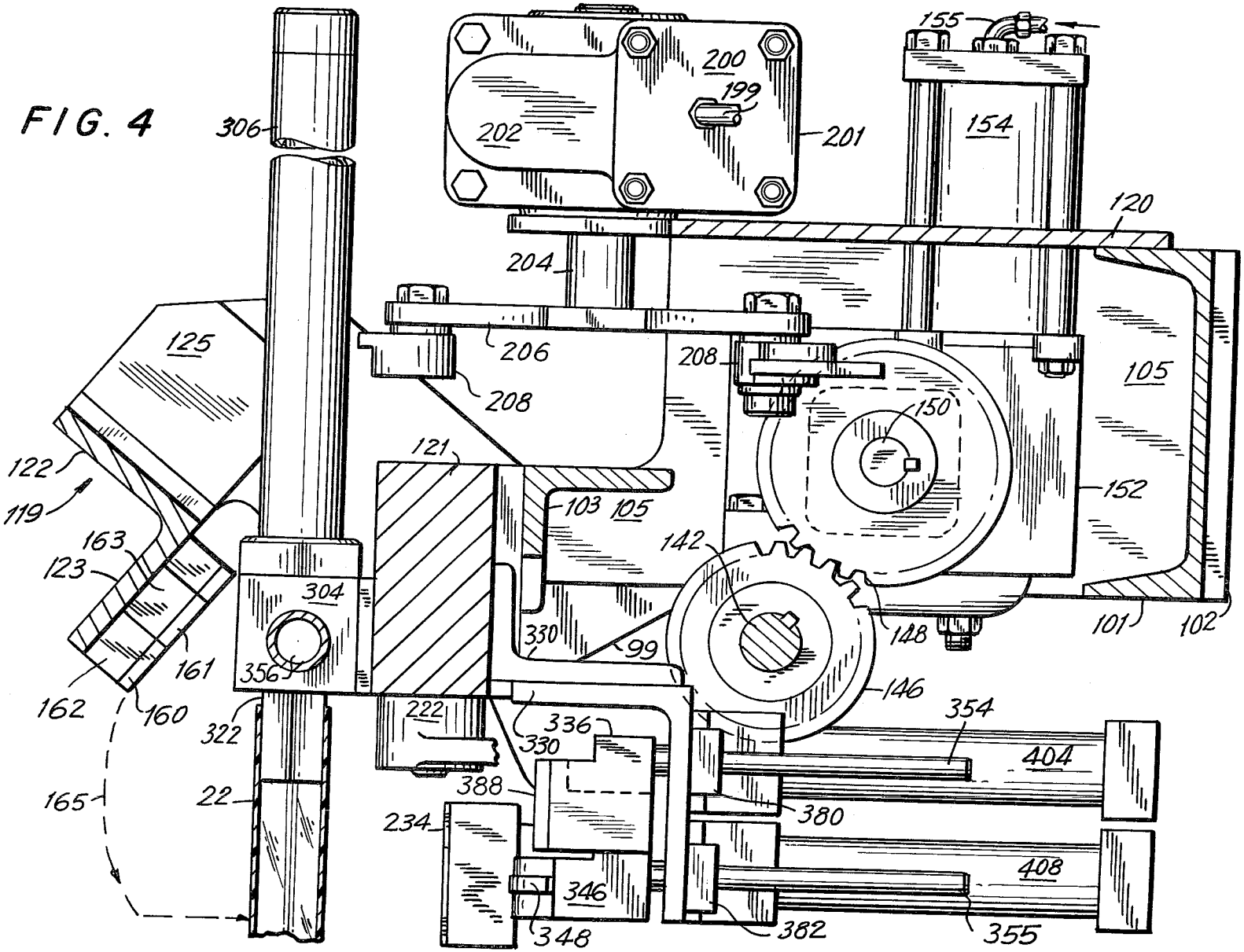
FIG. 4 is a sectional view taken along the section line 4—4 of FIG. 2.
Figure 5:
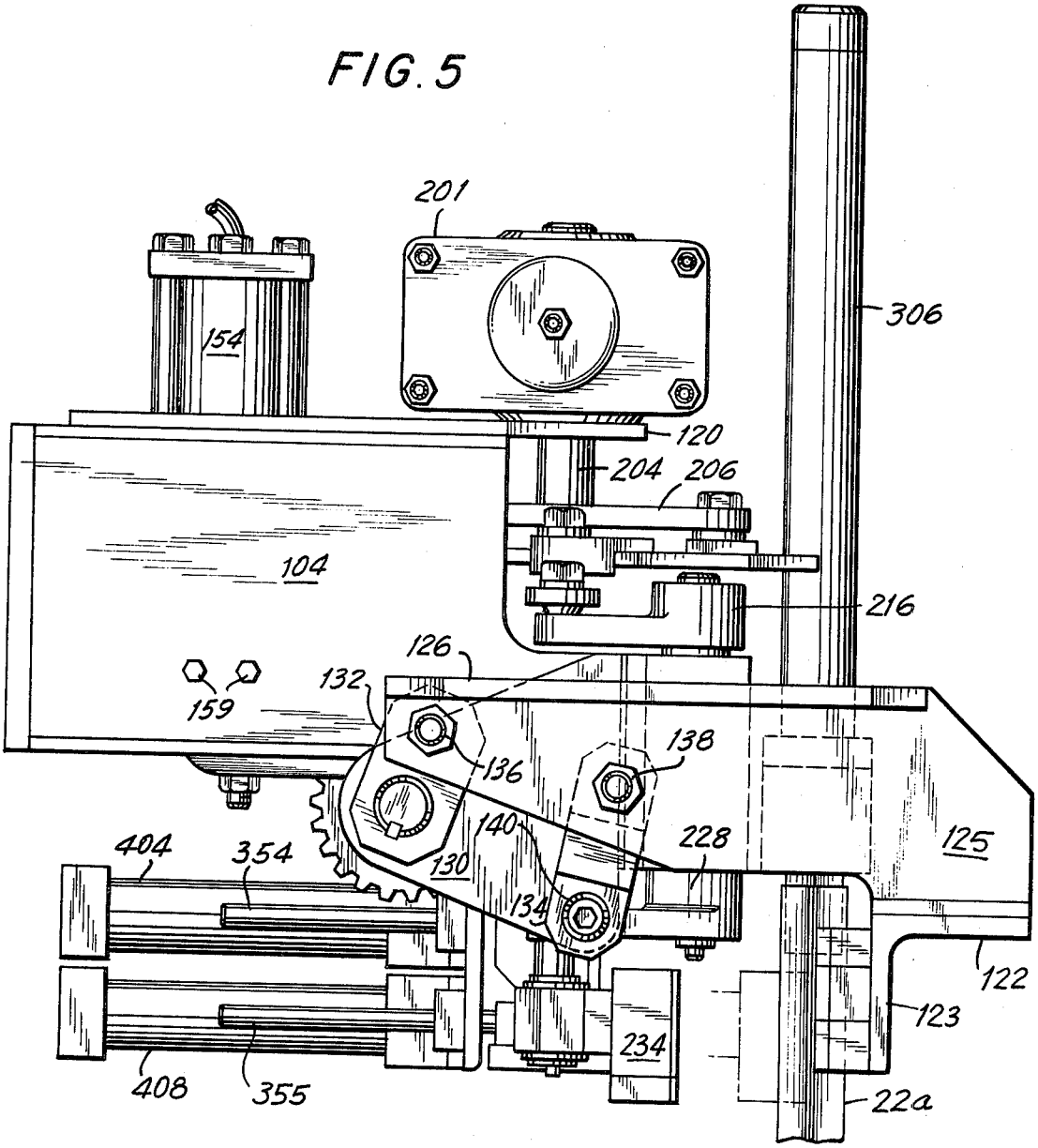
FIG. 5 is a left side view of the apparatus shown in FIG. 2.

Referring to FIGS. 2 and 4, the shaft 142 is keyed to a spur gear 146 which engages a pinion 148. The pinion 148 is keyed to shaft 150, as shown in FIG. 4. The shaft 150 extends outwardly from the gear housing 152, which is operatively connected to the cylinder 154. The cylinder 154 and the gear housing 152 are secured to the channel members 104 by bolts 159 as shown in FIG. 5. Returning to FIG. 4, by supplying an actuating air signal at 155 to the cylinder 154, the shaft 150 rotates through a given arc. In response, the pinion 148 rotates the spur gear 146 which, in turn, rotates the shaft 142. Thereby, each of the arms 125 is moved through an arc. Because of the spacing and dimensions of the links 132, 134, the support member 123 is moved along a curvelinear path. More particularly, the nature of the resulting movement is such that the first part of the movement is substantially along a circular arc and, then, the last part of the movement is substantially linear translation — as suggested by the broken line representation 165 shown in FIG. 4.

As shown in FIGS. 1 and 2, heat seal bars 234 are disposed on the under part of the machine. The heat seal bars 234 include longitudinally extending heat seal elements 236 and vertically extending heat seal elements 238. Each of the heat seal elements 236 and 238 are preferably thermal impulse heat sealing elements. Because the mounting of each of the heat seal bars 234 is the same, the following comments describe only the mounting of the heat seal bars 234 shown on the right side of FIG. 2. Thus, referring to FIG. 7, it will be seen that on the rear of the heat seal bar 234 there are provided two brackets 230, 232. Pins 226, 228 are secured in the brackets 230, 232, respectively. Each of the pins 226, 228 is rotatably received in links 222, 224, respectively. The links 222, 224 are fixedly secured to the shafts 218, 220, which extend through the holes 96, 98 respectively, shown in FIG. 1*a*.

Referring to FIG. 7, at the top of the block 121, links 212, 216, are fixedly secured to the shafts 218, 220 respectively. The links 212 and 216 are secured together by tie rod 214 which is in turn connected to the arm 210. As shown in FIG. 1*a*, a cut-out 104 is provided in one of the channel members 105 to allow the operating arm 210 to pass therethrough.

Figure 8:
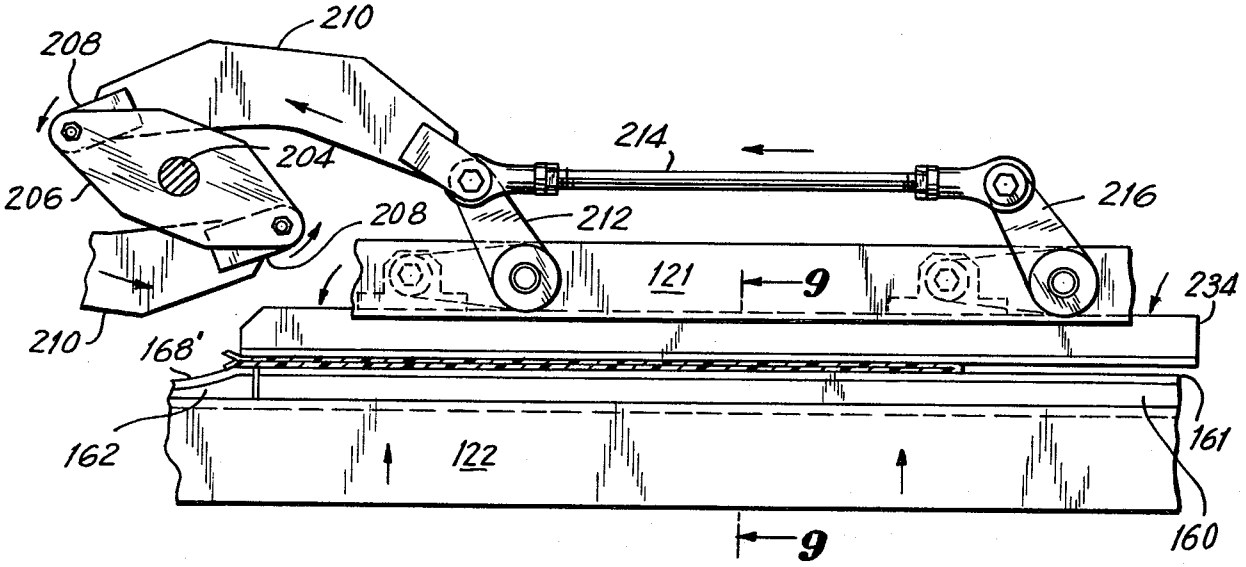
FIG. 8 is a top view of a portion of the apparatus shown in FIG. 1.

Referring to FIG. 3, it will be seen that each of the operating arms 210 is pivotally secured to a rotatable plate 206. As shown in FIG. 8, connecting links 208 provide the connection between the rotatable plate 206 and the arms 210. As shown in FIGS. 4 and 8, the plate 206 is secured to a shaft 204, which extends into a gear housing 202. The gear housing 202 is part of an air cylinder/gear drive unit 201 which includes an air cylinder 200. The unit 201 is secured to the plate 120, which in turn is secured to the channel members 104. Thus, when an appropriate signal is supplied at inlet 199 of the air cylinder 200, the shaft 204 is rotated through a predetermined arc, whereby the plate 206 shown in FIG. 8 is rotated in the direction indicated by the arrows. In response, the operating arms 210 are moved in the direction shown by the arrows and, similarly, the tie rod 214 is moved as suggested by the arrow in FIG. 8. In response to such movement and referring to FIG. 7, the links 222 and 224 rotate and, thereby, each of the heat seal bars 234 is moved forward, toward a bag positioned in the machine. In this connection, it is noted that the nature of the linkages 222 and 224 is such that the movement of each of the two heat seal bars 234 comprises movement of the bars towards each other when the bars move toward the front of the machine. With further regard to the linkage systems shown in FIGS. 3 and 7, it may also be noted that each of the heat seal bars, together with the two links 222, 224 and the block 124, comprise a four bar linkage and the tie rod 214, each of the links 212 and 216 and the block 121, comprises a second four bar linkage. Thus, each of the heat seal bars 234 moves as part of the first four bar linkage in response to movement of a second four bar linkage wherein the two four bar linkages are operatively connected.

Figure 9:
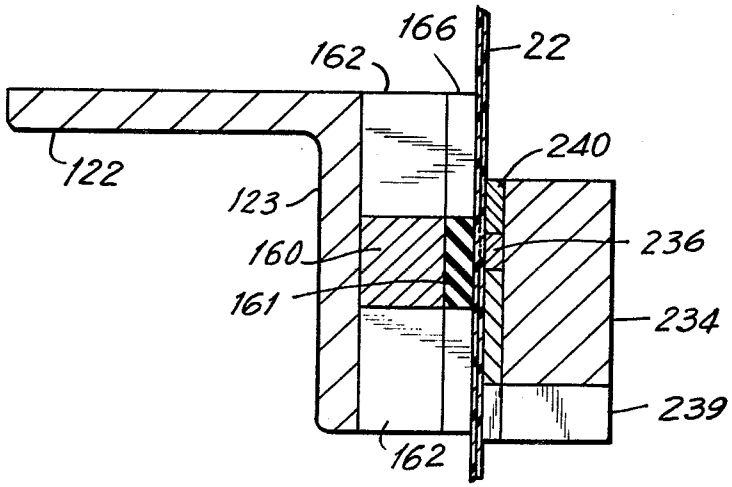
FIG. 9 is a sectional view taken along the section lines 9—9 of FIG. 8.

FIG. 9 shows that the bag 22 is sandwiched between the backing members 161 and the heat seal bars 234 when the heat seal bars are in their extended position.

Figure 10:
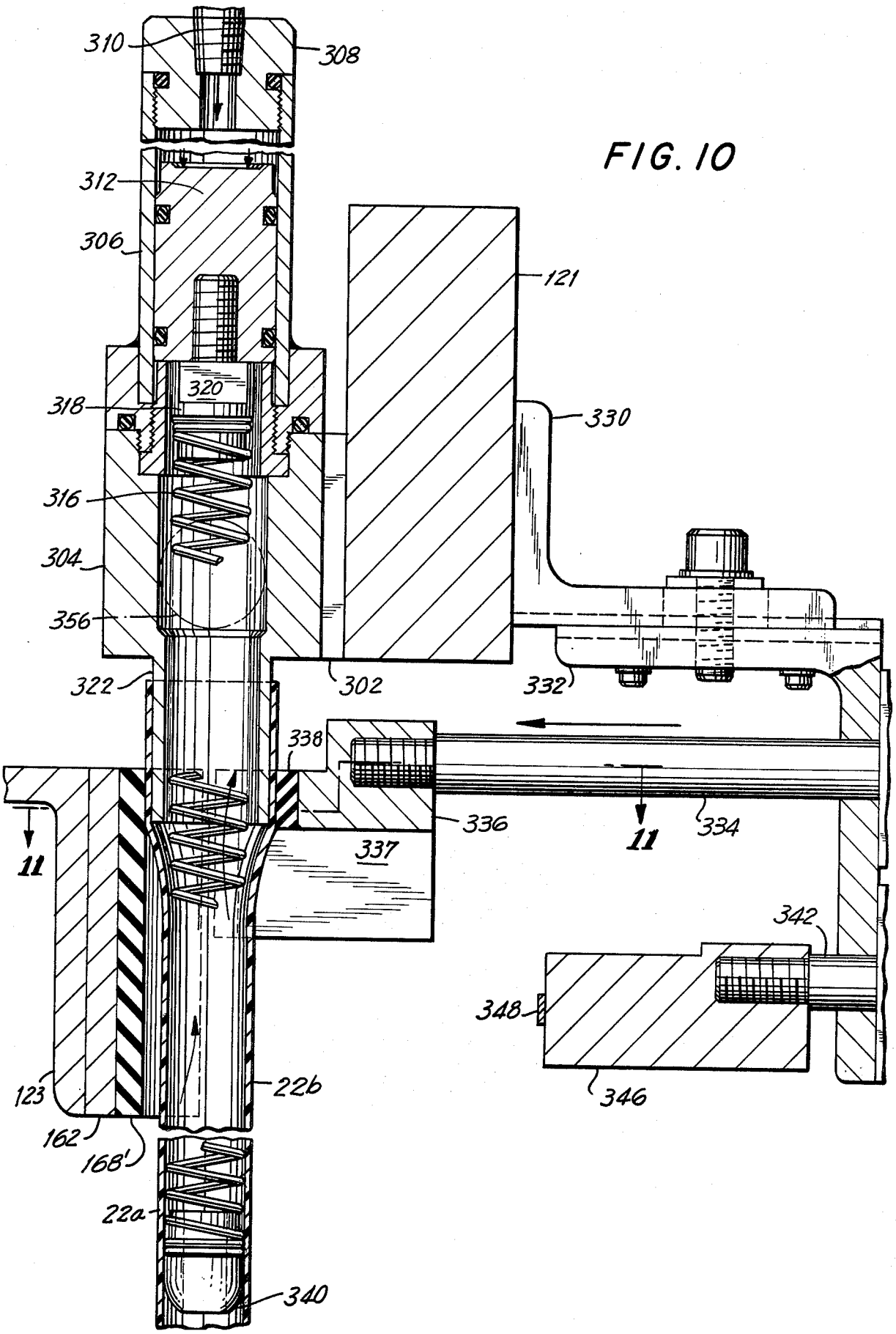
FIG. 10 is a side view, partially in section, of part of the apparatus shown in FIG. 1.

Referring to FIG. 10, it may be seen that a mounting plate 302 is secured to the block 121 and fixedly secured to mounting plate 302 is a manifold 304 having a downwardly extending elliptical portion 322. An aperture 356 is provided on the side of the manifold 304 and extending outwardly therefrom is a hose 357 shown in FIGS. 2 and 3. The hose 357 is connected to conventional valving elements whereby a vacuum may be pulled through the manifold and, thereafter, if desired another gas may be provided through the manifold. Conventional valving and gas supply means are known to those skilled in the art to which this invention pertains.

Referring again to FIG. 10, it will be seen that a cylinder 306 is fixedly secured to the manifold 304 and extends upwardly. Mounted in the cylinder 306 is a piston 312 which is connected by the bolt 320 and a connector element 318 to a helical spring 316. At the top 308 of the cylinder 306, there is a supply conduit 319 whereby, when an appropriate air signal is provided, the piston 312 may be driven downwardly or moved upwardly within the cylinder 306. In response to such movement of the piston 312, the helical spring 316 may be moved downwardly through the elliptical portion 322 of the manifold 304 and later retracted into the elliptical portion 322 of the manifold 304.

Figure 13:
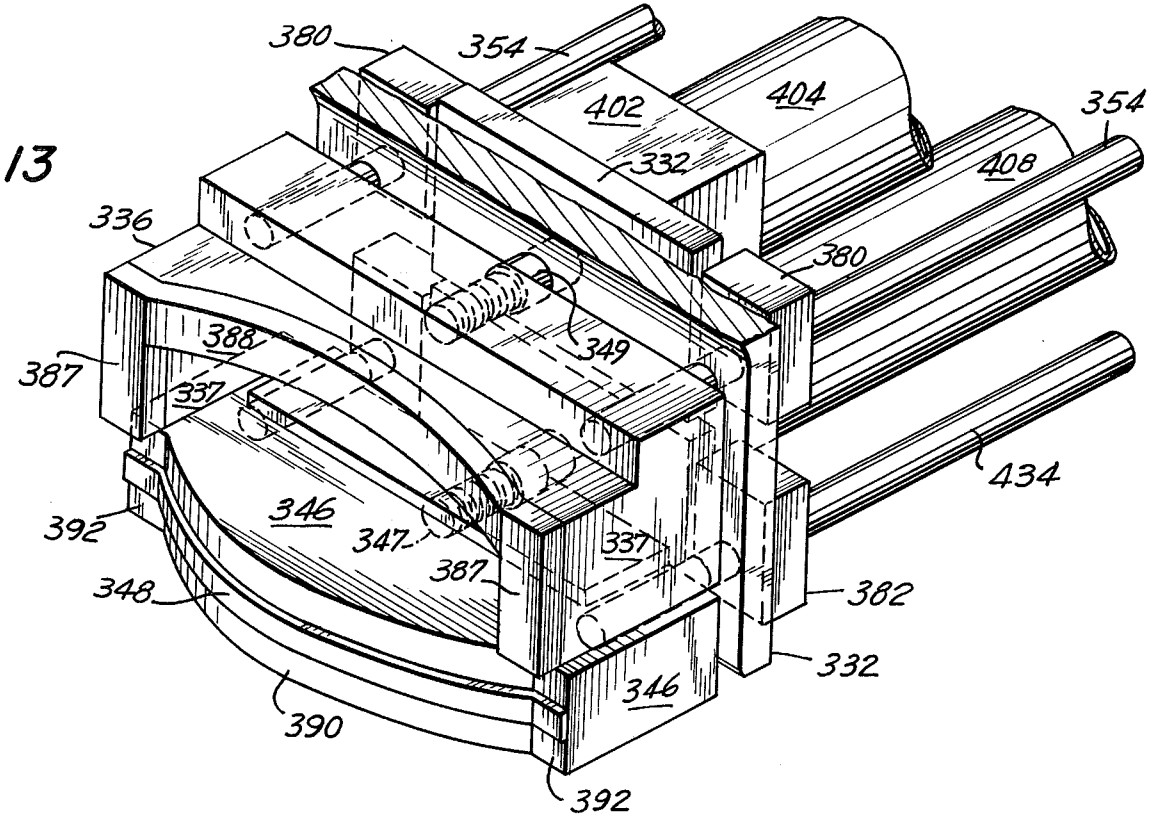
FIG. 13 is a perspective view of a portion of the apparatus shown in FIG. 1.

Referring to FIGS. 4, 5 and 13, two air cylinders 404 and 408 are mounted on a downwardly extending portion of the bracket 332. As shown in FIG. 13, the piston 349 associated with the cylinder 404 extends through the plate 332 and is received in a block 336. The front of the block 336 has a concave portion to which there is secured a rubber clamping member 388. The downwardly extending portions 337 of the block 336 provide planar surfaces on which there is mounted rubber clamping members 387.

The lower cylinder 408 shown in FIG. 13 includes a piston 347 which extends through the plate 332 and is received in a block 346. Block 346 includes a convex portion 390 and two planar portions 392. Secured to the face of the block 346 and in conforming relation thereto is a heat sealing strip 348. Preferably, the radius of curvature of the convex portion 390 is greater than the radius of curvature of the concave clamp 168.

OPERATION OF THE MACHINE

In operation, a machine of the type shown in FIG. 1 will operate as follows. The machine will be placed adjacent to a conveyor 20 as shown in FIG. 1. Upon movement of the conveyor, a box 21 is positioned beneath the machine and movement of the conveyor is stopped. Within the box is located a bag 22, e.g., a thermo-plastic bag. The bag may contain food items such as meat.

Referring to FIG. 2, when movement of the box stops, an operator places the right hand edge of the bag over the downwardly extending finger 164 and then pulls the left hand edge of the bag so as to place it over the left hand downwardly extending finger 164. In the process of pulling the bag, the right hand downwardly extending finger 164 is moved to the left against the compression of the spring 172. After the left hand edge of the bag is positioned over the left finger 164, the operator releases the bag and the bag is then held taut by the compression in spring 172. During the mounting of the bag on the fingers 164, the operator insures that the open portion of the bag encircles the downwardly extending portion of the manifold 304.

Figure 6:
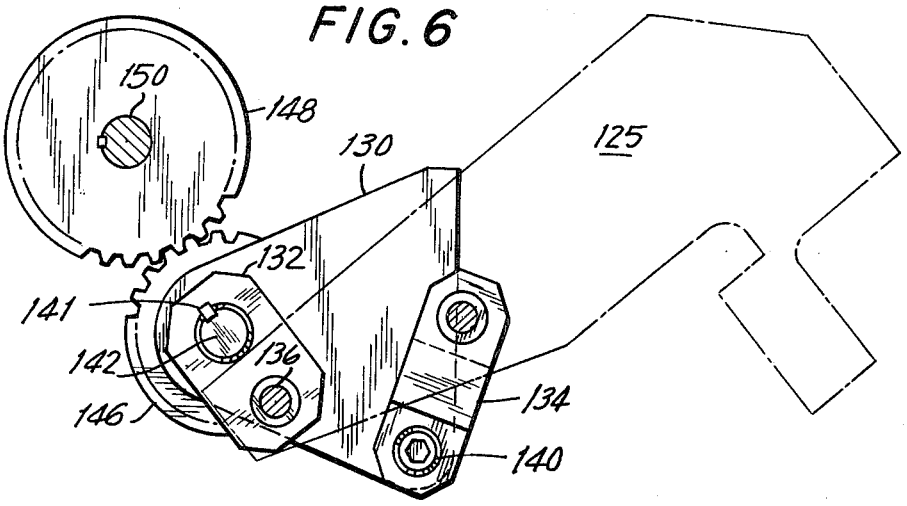
FIG. 6 is a side view of part of the apparatus shown in FIG. 5, with certain parts removed.

After the bag is positioned within the machine as described above, the operator presses a button and the following operations of the machine occur automatically. First, referring to FIGS. 1, 4, 5 and 6, a signal is supplied to the conduit 155 which actuates cylinder 154. In response, the shaft 150 shown in FIG. 4 is rotated, thereby rotating the gears 148 and 146 and thereby rotating the shaft 142 through a predetermined arc. Prior to such rotation, i.e., when the bag is initially placed within the machine, the support member 119 is in the position shown in FIGS. 1 and 6. Upon rotation of the gears 148 and 146, the arms 125 are moved with the links 134, 132. Thus, the support member 119 shown in FIG. 4 is moved along the curvelinear path suggested by the dotted line representation 165. In this manner, the support member 119 is moved from the position shown in FIGS. 4 and 6 to the position shown in FIG. 5, whereby a portion of the front wall of the bag 22 is sandwiched between the front surface of the elliptical manifold 322 and the concave, conforming rubber portion 168 shown in FIG. 1*b*.

At or near the end of the movement of the support member 119, an air signal is provided to the inlet 199 shown in FIG. 4, whereby the cylinder 200 is actuated. As a result, the gear housing 202 causes the shaft 204 to rotate through a fixed and predetermined arc. Thereby, the plate 206 moves the actuating arms 210 shown in FIGS. 3 and 8. As a result, each of the heat sealing bars 234 is moved toward the rear wall of the bag 22 and, during the course of such movement, each of the heat seal bars are moved toward each other. At the end of such movement, the bag 22 is sandwiched between the heat sealing bars and the backing member 161, as shown in FIG. 9. With respect to the movement of the heat sealing bars 234, it is important to note that, as suggested in FIG. 8, the movement of the bars results in the downwardly extending portions 238 of the heat sealing strip shown in FIG. 2 being positioned so as to sandwich the bag against the vertically extending clamps 160 shown in FIG. 1*b*.

After the heat sealing bars 234 have moved to their forward position, the heat sealing elements 236 and 238 shown in FIG. 3 are activated whereby two heat seals are formed in the bag, each of the heat seals extending from a respective edge of the bag toward the manifold and then extending along a line adjacent to the manifold from a point above the bottom end of the manifold to a point below the bottom end of the manifold. Prior to this it will be seen that each of the two heat seals which is formed is comprised of two portions, i.e., a portion which extends from one edge of the bag to a point adjacent to the manifold and then another portion which extends along to the side of the manifold from a point above the bottom end of the manifold to a point below the bottom end of the manifold.

After these two heat seals have been formed, the cylinder 200 shown in FIG. 4 is reverse actuated, whereby the plate 206 shown in FIG. 8 rotates in a direction opposite to the arrows shown therein. Thereby, the heat seal bars 234 are moved away from the bag and away from each other through the mechanism of the link arms 210 and the two sets of four bar linkages.

Figures 11, 12:
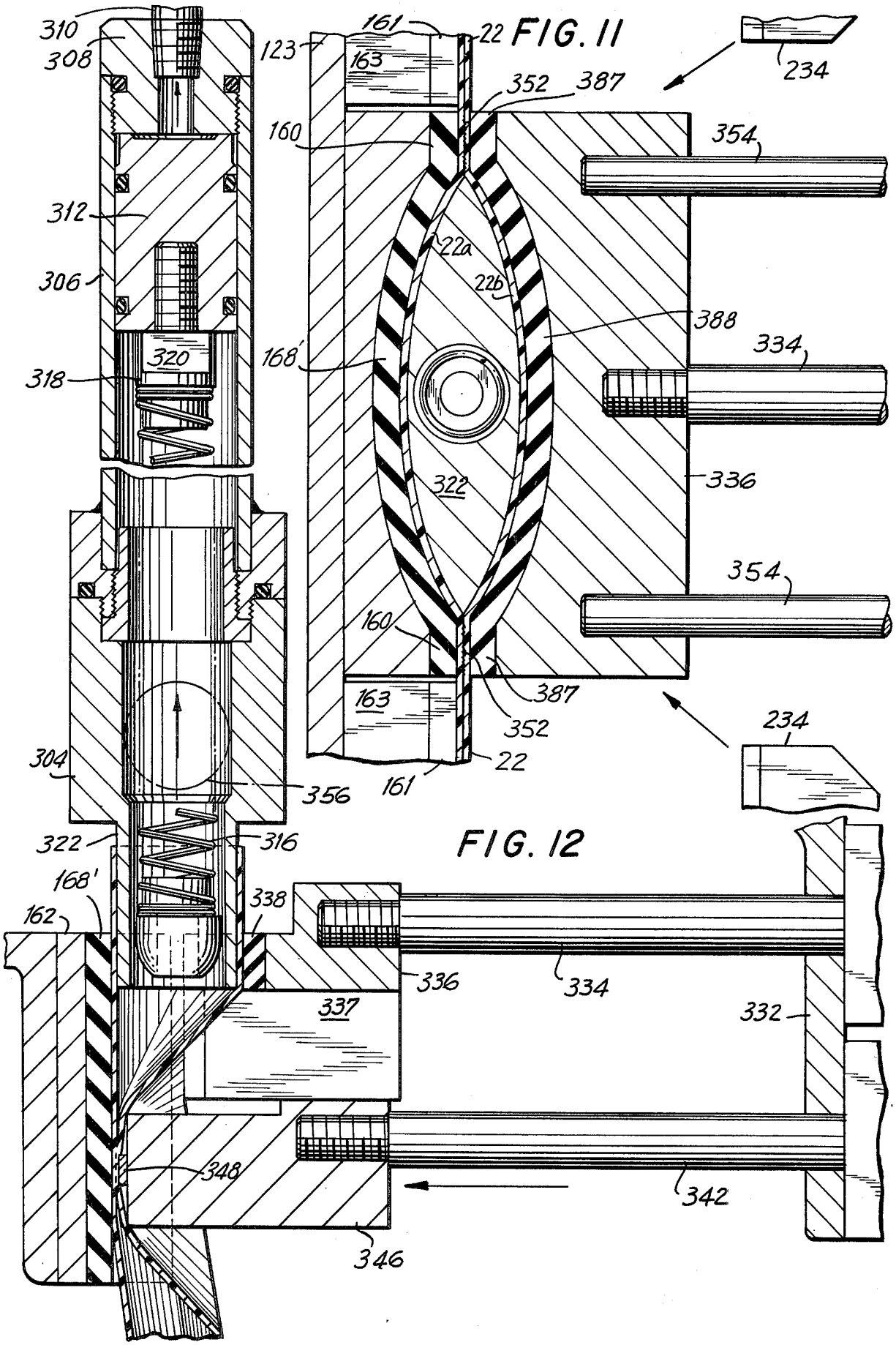
FIG. 11 is a sectional view taken along the section lines 11—11 of FIG. 10.
FIG. 12 is a side view, partially in section, showing a portion of the apparatus shown in FIG. 1.

At or about the time that the heat seal bars 234 are moved to their retracted position, the cylinder 404 shown in FIGS. 4 and 5 is actuated. Thereby, the block 236 is driven forward until the concave rubber portion 388 sandwiches one wall of the bag against the other side of the elliptical manifold 322. Additionally, at the end of the forward movement of the block 336, the two walls of the bag 22 adjacent to the side of the manifold are clamped together and sealed because they are sandwiched between the vertically extending rubber clamps 387 on the block 336 shown in FIG. 13 and the vertically extending, rubber clamps 160 shown in FIG. 1*b*. Thus, the unsealed portion of the bag is thereby temporarily sealed around the manifold. This condition is illustrated in FIG. 11 where it will be seen that the front wall portion 22*a* is sandwiched between one side of the manifold 322 and the rubber concave clamp 168' and the rear wall portion 22*b* of the bag 22 is sandwiched between the manifold 322 and the rubber concave clamp 388 on a block 336. Also, in FIG. 11 it will be seen that the planar vertically extending rubber clamps 160 and 387, clamp the adjacent portion of the bag, and, thereby, the bag is temporarily sealed around the manifold. Also shown in FIG. 11 is a portion of the vertically extending heat seal 352.

After the bag has been temporarily sealed around the manifold as shown in FIG. 11, an air signal is provided to the inlet 310 of the cylinder 306, whereby the piston 312 is driven downwardly causing the helical spring 316 to be moved downwardly through the unsealed portion of the bag. As shown in FIG. 10, a rounded and weighted member 340 may be secured to the end of the spring 316. The function of the spring 316 is to maintain the walls 22*a* and 22*b* of the bag 22 in spaced apart relation during withdrawal of the atmosphere from the bag 22.

After the spring 316 has been lowered into the bag 22, the atmosphere within the bag is withdrawn through the aperture 356. Then, through the aforementioned conventional valving, a new atmosphere is delivered into the bag 22. During the atmosphere withdrawing step, the end of the bag may automatically withdraw from the fingers 164 as a result of the bag collapsing.

Figure 14:
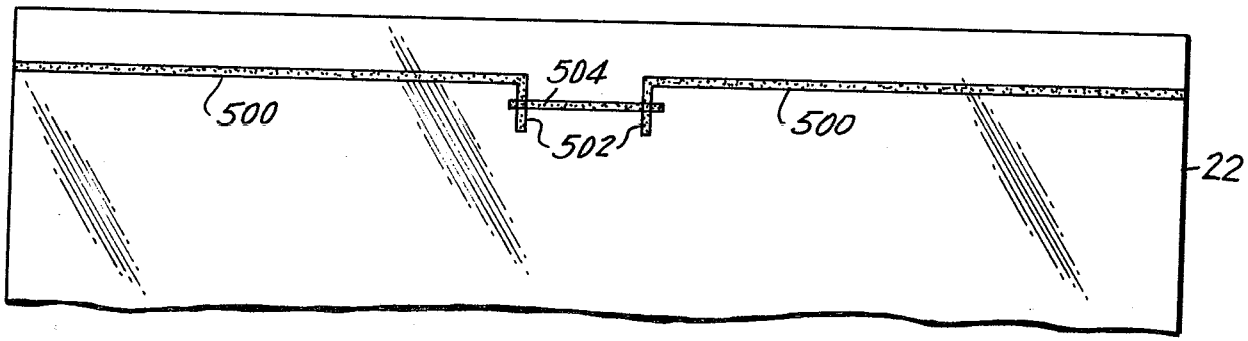
FIG. 14 is a front view of a bag which has been sealed using the apparatus of FIG. 1.

After delivery of at least some of the new atmosphere into the bag 22, a reverse actuating signal is provided to the inlet 310 of the cylinder 306 shown in FIG. 10, whereby the piston 312 is retracted, thereby retracting the spring 316 into the manifold 304, 322. When the spring 316 has been retracted into the manifold and a sufficient quantity of the new atmosphere has been delivered to the bag 22, the cylinder 408 shown in FIGS. 4 and 5, is actuated. Thereby, the block 346 is driven from its retracted position as shown in FIG. 10 to its extended position as shown in FIG. 12. In its extended position as shown in FIG. 12, the block 346 is positioned such that a portion of the bag 22 is sandwiched between the heat seal element 348 mounted on the block 346 and the rubber concave clamp member 168'. As previously noted, the radius of curvature of the face of the block 346 is preferably greater than the radius of curvature of the clamp 160 and, as a result, any excess bag material is flattened. When the heat seal element 346 is positioned as shown in FIG. 12 and is activated, a third heat seal is formed in the bag which extends along the bag from one of the vertical, flat rubber clamping faces 160 to the other clamping face 160. As a result, referring to FIG. 14, the heat seal 504 is formed whereby it will be seen that the heat seal 504 intersects the downwardly extending heat seals 502 which were formed by the downwardly extending members 238 shown in FIG. 2. Thus, upon activation of the heat seal member 348, the bag is completely sealed. Thereupon, the heat sealing element 348 is deactivated and the block 346 is withdrawn to its retracted position by reverse actuating the cylinder 408. Thereupon, the cylinder 404 is reverse actuated causing the block 336 with the clamping member 338 to be withdrawn. Substantially simultaneously, a reverse actuating signal is supplied to the inlet 155 of the air cylinder 154 shown in FIG. 4. Thereby, the gears 146 and 148 are reverse actuated, causing the support member 119 to move to its retracted position. At this point, the bag 22 will either fall off the elliptical portion of the manifold or maybe withdrawn therefrom by the operator. Thereupon, the conveyor 20 shown in FIG. 1 is actuated and the heat sealed bag, containing a new atmosphere, is removed from the machine area.

As previously indicated, the machine shown in FIG. 1 is preferrably automatically actuated. To accomplish this, a variety of sensing or control switches may be used in combination with appropriate actuators. For example, actuation of the machine may commence by the operator manually depressing a button or switch, which provides the initial actuating signal to the cylinder 154 shown in FIG. 4, which results in movement of the support member 119. To detect the end of such movement, a cam operated micro-switch may work in conjunction with rotation of the shaft 142 shown in FIG. 3. At the end of such rotation, a signal provided by this switch may be used to provide the air signal to the cylinder 200 shown in FIG. 4, which results in movement of the heat sealing bars 234. Rotation of the shaft 204 shown in FIG. 4 may be used in combination with a cam operated micro-switch to detect the end of the forward movement of the heat sealing bars 234. At the end of such forward movement, the signal thus generated may be used to actuate the current flow to the heat sealing elements and also to actuate a timer. When the aforesaid timer has timed out, the resulting signal will terminate the power to the heat sealing member and will provide a signal for reverse actuating the cylinder 200 to withdraw the heat seal bars 234. Again, rotation of the shaft 204 shown in FIG. 4 may be used with the aforementioned cam operated micro-switch to provide a signal indicating that the heat sealing bars 234 have been retracted. When such a signal has been generated, it may be used to actuate the cylinder 404 shown in FIG. 4, whereby the clamping block is moved to its forward position. Forward movement of the block 336 shown in FIG. 4 may trip a lever operated micro-switch, which will provide the signal to lower the spring 316 shown in FIG. 12 and also to commence the atmosphere exchange process. The atmosphere exchange process may be controlled from a timer actuated by movement of the block 336. When the timer has timed out, a signal may thus be generated to retract the spring 316 and, after a predetermined delay, to actuate the cylinder 408 to provide forward movement of the block 346. A lever operated micro-switch may be used to detect the end of the forward movement of the block 346 and, thereby, to provide a signal to actuate the heat sealing element 348 whereby the final heat seal is applied.

A timer may be used to control the length of time during which air is supplied to the heat sealing elements and, at the end of such time, the resulting signal may be used to reverse actuate the cylinders 404 and 408, as well as the cylinder 154 shown in FIG. 4. Thereby, the blocks 336 and 346 are withdrawn and the support member 119 is removed to its retracted position and the machine is then available to commence a new cycle.

Alternatively, a bank of cam operated micro-switches may be used wherein each of the switches is driven in timed relation by rotation of a common shaft.

Although a preferred embodiment of my invention has hereinbefore been described, the scope of my invention is to be determined by the claims appended hereto.

I claim:

1. A bag sealing machine which comprises:

(a) a frame;

(b) a manifold mounted on said frame;

(c) means for holding a bag to be sealed such that the open end of said bag is disposed around said manifold and said manifold extends downwardly into said bag;

(d) means for clamping one wall of said bag against one side of said manifold;

(e) means for effecting a first heat seal of said bag, said first heat seal extending outwardly from said manifold;

(f) means for effecting a second heat seal transversely of said first heat seal, said second heat seal extending from a point above the end of said manifold to a point below the end of said manifold; and, (g) means for effecting a third heat seal of said bag wherein said third heat seal extends transversely of and intersects said second heat seal.

2. The machine of claim 1 wherein said manifold is fixedly mounted on said frame.

3. The machine of claim 2 which further comprises:

(a) vacuum means and gas supply means connected to said manifold whereby the atmosphere in said bag may be exchanged after said first and second heat seals have been effected but before said third heat seal is effected.

4. A bag sealing machine which comprises:

(a) a frame;

(b) a manifold mounted on said frame;

(c) means for holding a bag to be sealed such that the open end of said bag is disposed around said manifold and said manifold extends downwardly into said bag;

(d) means for forming two heat seals in said bag, each of said heat seals extending from a respective edge of said bag to a point adjacent to a respective edge of said manifold and then extending from a point above the bottom end of said manifold to a point below the bottom end of said manifold;

(e) means for clamping opposite wall portions of said bag against said manifold; and (f) means for forming a third heat seal which extends along said bag below said manifold and which intersects portions of said two heat seals.

5. The bag sealing machine of claim 4 wherein said clamping means comprises:

(a) a first clamping member movably mounted on said frame for movement along a curvelinear path;

(b) a second clamping member movably mounted on said frame; and (c) means for moving said first and second clamping members.

6. The bag sealing machine of claim 5 wherein said second clamping member is mounted on said frame for reciprocating movement along a linear path.

7. The machine of claim 5 wherein said means for moving said first clamping member comprises:

(a) a support member, said first clamping member being mounted on said support member;

(b) two arms, each of said arms being secured to a respective end of said support members, and each of said arms forming one link in a four bar linkage system; and (c) means for rotating one of said links.

8. The bag sealing machine of claim 4 wherein said means for forming two heat seals comprises:

(a) two heat seal bars movably mounted on said frame for movement between a first position wherein said bars are removed from said bag to a second position wherein said bars are urged against said bag;

(b) means for moving said bars between said first and second positions wherein, during said movement from said first position to said second position, said bars also move toward each other.

9. The bag sealing machine of claim 8 wherein each of said bars form one member of a first four bar linkage.

10. The bag sealing machine of claim 9 which further includes:

(a) a second four bar linkage operatively connected to each of said first four bar linkages; and (b) means for moving each of said second four bar linkages.

11. A bag sealing machine which comprises:

(a) a frame;

(b) a manifold mounted on said frame;

(c) means for holding a bag to be sealed such that the open end of said bag is disposed around said manifold and said manifold extends downwardly into said bag;

(d) a first pair of clamps movable between a first position which is remote from said manifold to a second position wherein said clamps are vertically disposed adjacent to the side edges of said manifold;

(e) means for forming two heat seals in said bag wherein each of said heat seals extends from a respective end edge of said bag to a respective one of said first pair of clamps and then extends along said respective one of said first pair of clamps;

(f) a third clamp movable between a first position which is remote from said manifold to a second position wherein said third clamp clamps a portion of said bag against one side of said manifold;

(g) a fourth clamp for clamping the other wall of said bag against the other side of said manifold;

(h) fifth and sixth clamps movable between a first position which is remote from said manifold to a second position wherein said fifth and sixth clamps clamp a portion of said bag against said first pair of clamps; and (i) means for forming a third heat seal in said bag wherein said third heat seal extends between said first pair of clamps and intersects the portion of said two heat seals which extend along said first pair of clamps.

12. The bag sealing machine of claim 11 which further comprises:

(a) a support arm movably mounted on said frame, said first pair of clamps and said third clamp being fixedly mounted on said support arm; and (b) means for moving said support arm between a first position and a second position.

13. The bag sealing machine of claim 12 wherein said support arm moving means includes means for moving said support arm along a curvelinear path.

14. The bag sealing machine of claim 13 wherein said means for forming two heat seals comprises:

(a) two backing members mounted on said support arm; and (b) two heat seal bars movably mounted on said frame; and (c) means for moving each of said heat sealing bars against a respective one of said two backing members.

15. The bag sealing machine of claim 14 wherein said heat seal bar moving means also moves each of said heat seal bars toward each other when said heat seal bars are moved toward said backing members.

16. The bag sealing machine of claim 15 wherein said manifold is fixedly mounted on said frame.

17. The bag sealing machine of claim 11 wherein said manifold has an elliptical cross section, said third and fourth clamps are concave and said means for forming a third heat seal is convex.

18. An atmosphere exchange machine which comprises:

(a) a frame;

(b) a manifold fixedly mounted on said frame;

(c) means for holding a bag to be sealed such that the open end of said bag is disposed around said manifold and said manifold extends downwardly into said bag;

(d) means for heat sealing together the opposite portions of said bag, which extend outwardly from said manifold, before the atmosphere in said bag is exchanged;

(e) means for clamping the unsealed portion of said bag to said manifold;

(f) means for exchanging the atmosphere in said bag through said manifold; and (g) means for heat sealing together the unsealed portions of said bag and thereby completely sealing said bag after the atmosphere exchange and while said manifold is disposed within said bag.

19. The machine of claim 18 wherein said means for heat sealing together the opposite portions of said bag comprises:

(a) a pair of backing members;

(b) a pair of heat sealing bars;

(c) means for bringing together said backing members and said heat sealing bars so that portions of said bag are sandwiched therebetween.

20. The machine of claim 19 wherein said heat sealing bars are movably mounted for movement toward and away from said backing members and for movement toward each other when said bars move toward said backing members.

21. The machine of claim 20 wherein said clamping means comprises a first clamp for clamping one wall of said bag against one side of said manifold and a second clamp for clamping the other wall of said bag against the other side of said manifold.

22. The machine of claim 21 wherein said first clamp and said backing members are mounted on a common support member.

23. The machine of claim 22 wherein said common support member is movably mounted for movement along a curvelinear path.

24. The machine of claim 23 wherein each of said heat sealing bars is one member of a four bar linkage.

25. The machine of claim 24 wherein said manifold is elliptical in cross section and said first and second clamps are concave.

26. The machine of claim 25 wherein said means for heat sealing together the unsealed portions of said bag comprises a movably mounted, convex heat seal member and means for moving said convex heat seal member from a first position remote from said bag to a second position wherein a portion of said bag is sandwiched between said convex heat seal member and said first clamp.

27. The machine of claim 26 wherein the radius of curvature of said convex heat seal member is greater than the radius of curvature of said first clamp.

28. The machine of claim 18 which further comprises:

(a) means for maintaining in spaced apart relation, during the evacuation of said bag, the wall portions of said bag which are disposed below said manifold.

29. The machine of claim 28 wherein said spacing means is mounted for movement through said manifold.

30. A method of heat sealing a bag which is mounted on a machine and wherein a manifold on said machine extends into said bag, said method comprising the steps of:

(a) partially heat sealing bag while said manifold extends into said bag;

(b) temporarily sealing the unsealed portion of said bag around said manifold;

(c) operating on said bag through said manifold; and then (d) heat sealing the remaining unsealed portion of said bag, while said manifold is still disposed within said bag and thereby forming a complete heat seal of said bag.

31. The method of claim 30 wherein said operating step includes the step of withdrawing the atmosphere from said bag.

32. The method of claim 31 which further includes the step of substituting a new atmosphere for the withdrawn atmosphere.

33. The method of claim 31 which further comprises the step of maintaining portions of the bag walls in spaced apart relation during said withdrawing step.

34. A method of heat sealing a bag which is mounted on a machine and wherein a manifold on said machine extends into said bag, said method comprising the steps of:

(a) forming two heat seals in said bag, each of said heat seals extending from a respective edge of said bag to a point adjacent to a respective edge of said manifold and then extending from a point above the bottom end of said manifold to a point below the bottom end of said manifold;

(b) temporarily sealing the unsealed portions of said bag around said manifold;

(c) operating on said bag through said manifold; and then (d) forming a third heat seal, while said manifold is disposed within the end of said bag, wherein said third heat seal extends across the unsealed portion of said bag and intersects portions of said two heat seals.

35. The method of claim 34 wherein said temporary sealing step comprises the steps of:

(a) clamping opposite wall portions of said bag against said manifold; and (b) sandwiching portions of said bag which are adjacent to said manifold between opposing clamps.

36. The method of claim 35 wherein said clamping step comprises the steps of:

(a) moving a first clamp along a curvelinear path so that a first wall portion of said bag is sandwiched between said first clamp and one side of said manifold; and (b) moving a second clamp into position to sandwich a second wall portion of said bag between the other side of said manifold and said second clamp.

37. The method of claim 34 wherein said step of forming two heat seals comprises the steps of:

(a) moving two backing members into position adjacent to one wall of said bag; and (b) moving two heat seal bars so as to sandwich portions of said bag between said bars and said backing members.

38. The method of claim 37 wherein said two heat seal bars move toward each other when they move toward said bag.

39. The method of exchanging the atmosphere in a bag and then sealing said bag which comprises:

(a) mounting a bag such that a portion of said bag surrounds a manifold;

(b) forming two heat seals in said bag, each of said heat seals extending from a respective edge of said bag to a point adjacent to a respective edge of said manifold and then extending from a point above the bottom end of said manifold to a point below the bottom end of said manifold;

(c) temporarily sealing the unsealed portions of said bag around said manifold;

(d) withdrawing the atmosphere from said bag;

(e) flowing a gas into said bag; and then (f) forming a third heat seal, while said manifold is disposed within the end of said bag, wherein said third heat seal extends across the unsealed portion of said bag and intersects portions of said two heat seals.

40. The method of claim 39 which further comprises the step of maintaining portions of the bag walls in spaced apart relation during said withdrawing step.

41. The method of claim 40 wherein said maintaining step comprises the step of lowering a spacer member into said bag, through said manifold, before said atmosphere is withdrawn.

* * * * *